US007797973B2

(12) United States Patent
Field et al.

(10) Patent No.: US 7,797,973 B2
(45) Date of Patent: Sep. 21, 2010

(54) HIERARCHICAL CYLINDER LOCK SYSTEMS

(75) Inventors: Peter H. Field, Salem, VA (US); David P. Sutherland, Roanoke, VA (US); Clyde T. Roberson, Salem, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

(21) Appl. No.: 12/046,756

(22) Filed: Mar. 12, 2008

(65) Prior Publication Data

US 2008/0223097 A1 Sep. 18, 2008

Related U.S. Application Data

(60) Provisional application No. 60/894,792, filed on Mar. 14, 2007.

(51) Int. Cl.
*E05B 27/04* (2006.01)
*E05B 27/08* (2006.01)

(52) U.S. Cl. ..... 70/337; 70/491; 70/494; 70/495; 70/496

(58) Field of Classification Search ..... 70/419, 70/402, 405–407, 409, 411, 491, 493–496, 70/337–343
See application file for complete search history.

(56) References Cited

U.S. PATENT DOCUMENTS 3,499,302 A 3/1970 Spain et al.
3,722,240 A 3/1973 Spain et al.
4,103,526 A 8/1978 Surko, Jr.
4,356,713 A 11/1982 Widen
4,393,673 A 7/1983 Widen
4,635,455 A 1/1987 Oliver
5,289,709 A 3/1994 Field
5,419,168 A 5/1995 Field
5,570,601 A 11/1996 Field
5,615,565 A 4/1997 Field (Continued)

FOREIGN PATENT DOCUMENTS

DE 2828343 A1 1/1980

OTHER PUBLICATIONS

International Search Report for PCT/US2008/003228, 5 pgs. (Jul. 15, 2008).

(Continued)

*Primary Examiner*—Lloyd A Gall
(74) *Attorney, Agent, or Firm*—Rothwell, Figg, Ernst & Manbeck, PC

(57) ABSTRACT

A hierarchical lock system includes a first cylinder lock having a cylindrical plug, rotatable, reciprocating tumbler pins, a slider disposed within the plug and a side bar that cooperates with the cylinder plug, the slider, and the tumbler pins to control rotation of the lock. A second cylindrical lock includes a cylindrical plug, reciprocating tumbler pins, a slider, and a side bar that cooperates with the cylindrical plug and the slider. A first key is configured to open both the first and second locks by elevating and rotating the tumbler pins, and moving the slider to an unlocked position with respect to the side bar. A second key is able to open only the second cylindrical locks by elevating but not rotating the tumbler pins and by moving the slider to an unlocked position with respect to the side bar.

15 Claims, 6 Drawing Sheets

U.S. PATENT DOCUMENTS

| | | | |
|---|---|---|---|
| 6,023,954 | A | 2/2000 | Field |
| 6,477,875 | B2 | 11/2002 | Field et al. |
| 6,945,082 | B2 | 9/2005 | Field et al. |

OTHER PUBLICATIONS

Written Opinion for PCT/US2008/003228, 7 pgs. (Jul. 15, 2008).
International Preliminary Report on Patentability for PCT/US2008/003228, 18 pgs. (Aug. 17, 2009).

HIERARCHICAL CYLINDER LOCK SYSTEMS

CROSS REFERENCE OF RELATED APPLICATION

This application claims priority from U.S. Provisional Application No. 60/894,792 filed Mar. 14, 2007, the disclosure of which is hereby incorporated by reference.

FIELD OF THE INVENTION

This invention relates to cylinder locks having tumbler pins which, when operated with the proper keys, are positioned to permit operation of the lock, and particularly to security locks arranged in systems where different cylinders offer varying degrees of physical security, and can be operated by keys in a hierarchical arrangement.

BACKGROUND OF INVENTION

Customers of security lock systems have recognized the importance of having high security mechanisms on vulnerable doors. The protection offered by these cylinders more than justifies their cost. However the expense to equip all the doors in a facility with modern high security cylinders often offsets the potential benefit of having high security cylinders on nonessential doors. Many customers choose to install and maintain two different master key systems, one for the high security doors and one for the common, less critical doors, thus having more keys to manage and carry for access.

This has lead to the development of so-called hierarchical lock systems. A hierarchical lock system includes one or more high security cylinders, typically installed on critical, high-risk doors, and associated lower security cylinders installed on less critical doors. The lower security cylinders are "associated" with the high security cylinders in the sense that a high-security master key, capable of operating the high security cylinder, is also capable of operating each of the associated lower security cylinders. Lower security keys for operating the associated lower security cylinders are not, however, capable of operating the high security cylinders with which the cylinders are associated. Each lower security cylinder may also have one or more associated cylinders of still lower security. And any key capable of operating cylinders at one security level is also capable of operating associated cylinders at lower levels, but the keys constructed to operate only lower security cylinders cannot operate higher security cylinders with which the lower security cylinders are associated.

In the context of this description, a standard security cylinder is a cylinder having fewer security features than a high security cylinder. The standard security cylinder is not necessarily the cylinder with the fewest security features within any particular hierarchical scheme.

Several lock manufacturers currently make cylinders that can be arranged into systems with different levels of physical security. As the industry produces new and higher security products it is necessary to develop standard security lock cylinders (i.e., non-high security cylinders) that will interface into systems with the newer high security cylinders and be operated by the high security keys. Notwithstanding improvements in the well worked lock art, there remains a need for lock cylinders which offer different levels of protection against criminal attack or other unauthorized entry and which can be arranged into one hierarchical keying schedule.

Such lock mechanisms should also resist contemporary lock picking techniques, and it is desirable that the dimensions of the lock not exceed conventional cylinder size. It is equally important that the components and the lock assembly can be economically mass produced.

PRIOR ART

In U.S. Pat. No. 4,103,526, Serko, Jr teaches a cylinder that has interconnected rotating pins. Insertion of a proper angularly bitted key into the key plug causes the tumbler assemblies to elevate and rotate to predetermined releasing positions wherein a split line of each tumbler assembly is aligned with a shear line between the plug and the shell and each pin tumbler is free to separate from its associated driver to permit rotation of the key plug to an unlocked position. Emhart Industries, Inc. (Berlin, Conn.) introduced this cylinder into the lock market as the high security cylinder in a two-level hierarchical keying system. The corresponding standard security cylinder is a common pin cylinder with conically-shaped pin tips and keys having conventional, straight bittings. The standard security keys will not operate the high security cylinder which requires that the pin tumblers be elevated and rotated, but, the high security key will position the common pins in the standard security cylinder. There are no additional security enhancements in the standard security cylinder.

In German patent DE 2828343, Perkut shows a pin tumbler cylinder with two axial sliding pins located beside the key way. The pins are positioned by ribs extending from the side of the key. This cylinder has been manufactured by Gebr. Grundmann Gesellschaft m.b.H., (Herzogengerg, Austria) and sold as the high security cylinder in a hierarchical keying system. The standard security cylinder is manufactured without the axially sliding pins, and the standard security key for the standard security cylinder does not have the side ribs to position the sliding pins in the high security cylinder. The high security key will operate both the high security cylinder and the standard security cylinder, because the standard security cylinder has a key way that is designed to accept the wider key of the high security design.

In U.S. Pat. Nos. 4,356,713, 4,393,673 and others, Widen introduced a high security sidebar locking cylinder that could be used in a hierarchical keying system. In one product, the standard security cylinder uses only common pin tumblers, and does not utilize the side pins that are in the high security cylinder. The standard security key will only operate in the standard security cylinder. The high security key will operate both levels of cylinders.

In U.S. Pat. No. 5,419,168, the disclosure of which is incorporated herein by reference, Field discloses a hierarchical system of locks wherein each key is provided with at least one unique bitting surface that engages a complementarily shaped tumbler pin tip to cause the tumbler pin to rotate and be positioned at a predetermined location. In one system, one high security key is provided with bittings to rotate the tumbler pins in a lock that is able to determine the rotational position of the tumbler pins. The high security key may also operate a standard security cylinder—which does not determine the rotational position of the tumbler pins—by positioning a tumbler pin at its proper elevation in the cylinder. The standard security key, which has at least one different bitting from the high security key, will operate the standard security cylinder (in which the tumblers do not have to be rotated). The standard security key will not, however, operate the high security cylinder, because the bitting does not properly rotate the tumbler pins to their unlocking locations.

Cylinders which read the rotational positioning of the tumbler pins require that the tumbler pins be individually rotated to a predetermined position to permit rotation of the plug or barrel. Such cylinders can be operated only by a key which is bitted so as to rotate the tumbler to the predetermined position. On the other hand, lock cylinders which do not have a mechanism which reads or differentiates between rotational positions of the pins can be operated by any key which is bitted so as to position the pins at their proper elevation and permit rotation of the plug or barrel, regardless of the rotational position to which the key moves the pins.

In U.S. Pat. Nos. 6,477,875 and 6,945,082, the disclosures of which are incorporated herein by reference, Field et al. teach lock cylinders that require the precise elevational and rotational positioning of rotating pins and the proper axial positioning of a reciprocating, sliding sidebar blocking mechanism (referred to as a slider) before their plugs will turn. The unique key that operates the cylinder has a portion of a rib configured to cooperate with the slider in the cylinder. The slider provides hierarchical key system differentiation by allowing master keying possibilities on the slider contact areas. It provides an additional bitting member and enhanced security against picking and manipulation. Some examples of slider contact surfaces on the slider are illustrated in U.S. Pat. No. 6,945,082, FIG. 8 at reference numbers 721,713. Also, some examples of slider engaging projections on keys are illustrated in U.S. Pat. No. 6,945,082, FIG. 14a at reference numbers 4007, 4008.

The slider and side key bitting also reduces the need for manufacturing as many cylinders of differing key ways to produce a large master keyed system, as the slider mechanism expands the master keying capability of the cylinders without relying on different key sections to reject improperly configured keys.

SUMMARY OF THE INVENTION

Against this background, the primary object of this invention is to provide an improved locking cylinder of the general kind indicated in the opening paragraph, that will fit into a hierarchical arrangement of cylinders providing a cost effective solution to supplement high security cylinders and keys of the kinds described in U.S. Pat. Nos. 6,477,875 and 6,945,082.

Aspects of the invention are embodied in a lock which comprises a cylindrical plug having an axis and an axially-extending keyway adapted to receive a conforming key. The lock also includes tumbler pin assemblies disposed within tumbler pin holes that are formed in the cylindrical plug and which are adapted to control rotation of the cylindrical plug with respect to a shell. Each tumbler pin assembly is reciprocally moveable within an associated tumbler pin hole, and engagement of the tumbler pin assemblies by the biting of a properly configured key inserted into the keyway will position the tumbler pin assemblies within their associated tumbler pin holes so as to permit the cylindrical plug to rotate with respect to the shell. A sidebar is coupled with the cylindrical plug and has an outer end that is engageable with a sidebar groove formed in the wall of a bore formed in the shell. When engaged with the sidebar groove, the sidebar blocks rotation of the cylindrical plug with respect to the shell. A slider is disposed with respect to the cylindrical plug and is adapted to move axially relative to the cylindrical plug, when engaged by a properly configured key inserted into the keyway, from a first position in which the slider interferes with the sidebar to block the sidebar from moving radially inwardly toward the axis of the cylindrical plug to a second position in which the slider does not interfere with the sidebar. With the slider moved to the second position, the sidebar is permitted to move radially toward the axis of the cylindrical plug so that the sidebar disengages from the sidebar groove and permits the cylindrical plug to rotate within the bore formed in the shell. The lock is unlocked when the tumbler pin assemblies are positioned so as to permit the cylinder plug to rotate and the slider is moved to its second position so as to permit the sidebar to move radially inwardly and disengage from the sidebar groove.

Other aspects of the invention are embodied in a hierarchical lock system which includes a first cylinder lock having a rotatable cylinder with an axis and a keyway, a movable sidebar for controlling rotation of the cylinder, rotatable reciprocating tumblers for controlling rotation of the cylinder and movement of the sidebar, and a slider adapted to be engaged by a key inserted into the keyway for controlling movement of the sidebar. The system further includes a second cylinder lock having a rotatable cylinder with an axis and a keyway, a movable sidebar for controlling rotation of the cylinder, reciprocating tumblers for controlling rotation of the cylinder, and a slider adapted to be engaged by a key inserted into the keyway for controlling movement of the sidebar. The system also includes a dual level key adapted to open both the first and second cylinder locks and a single level key adapted to open the second cylinder lock but not the first cylinder lock.

Other aspects of the invention are embodied in a set of keys which includes a first key comprising a key blade adapted to fit into the keyways of the first and second cylinder locks described above and constructed and arranged to (1) elevate the tumblers of the first cylinder lock to positions which allow the cylinder of the first cylinder lock to rotate, (2) rotate the tumblers of the first cylinder lock to orientations which unblock the sidebar of the first cylinder lock, and (3) elevate the tumblers of the second cylinder lock to positions which allow the cylinder of the second cylinder lock to rotate. The blade of the first key is further constructed and arranged to engage the sliders of the first and second cylinder locks and move each slider parallel to the axis of the cylinder to unblock the sidebar of the first and second cylinder locks. The set of keys also includes a second key which comprises a key blade adapted to fit into the keyways of the first and second cylinder locks and constructed and arranged to elevate the tumblers of the second cylinder lock to positions which allow the cylinder of the second cylinder lock to rotate. The blade is further constructed and arranged to engage the slider of the second cylinder lock and move the slider parallel to the axis of the cylinder to unblock the sidebar of the second cylinder lock. The second key is not adapted to rotate the tumblers of the first cylinder lock and is therefore unable to open the first cylinder lock.

Other objects, features, and characteristics of the present invention, including the methods of operation and the function and interrelation of the elements of structure, will become more apparent upon consideration of the following description and the appended claims, with reference to the accompanying drawings, all of which form a part of this disclosure, wherein like reference numerals designate corresponding parts in the various figures.

DETAILED DESCRIPTION OF THE PREFERRED EMBODIMENTS

Figure 1:
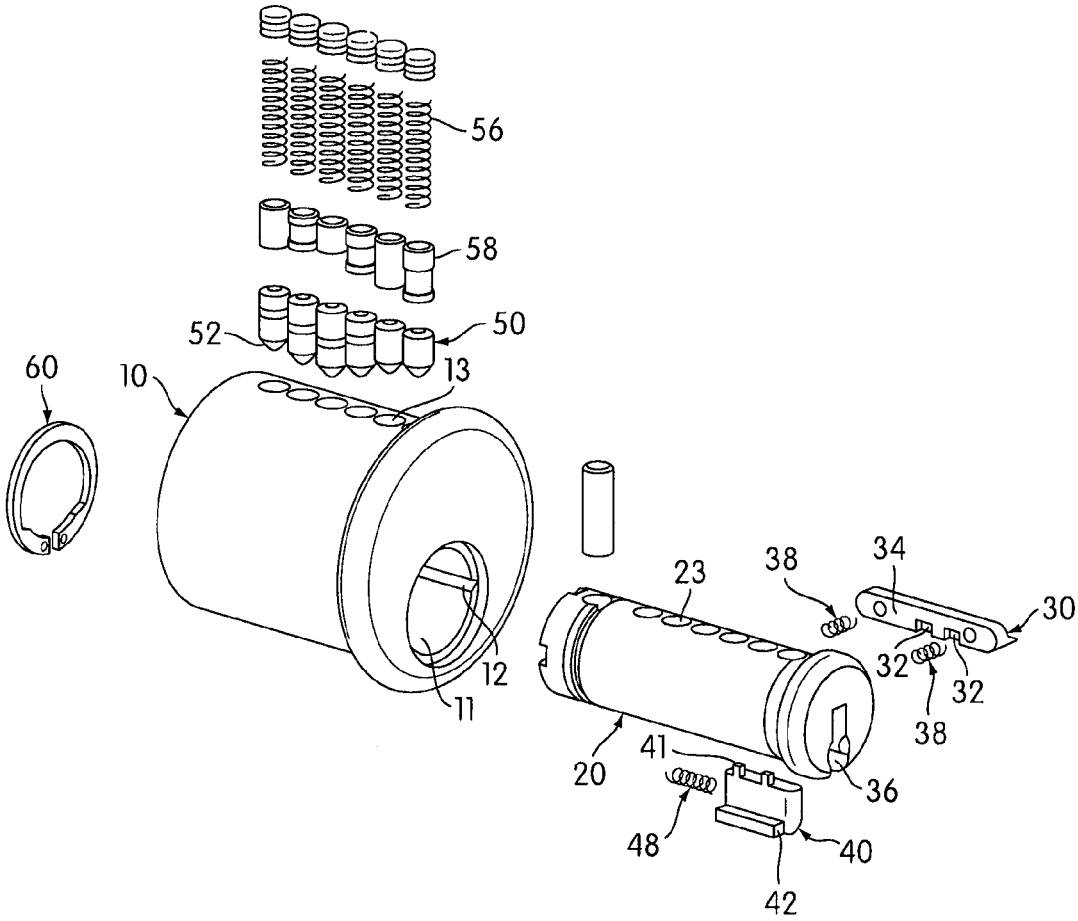
FIG. 1 is a left-hand exploded perspective view of a standard security cylinder of the present invention.
Figure 2:
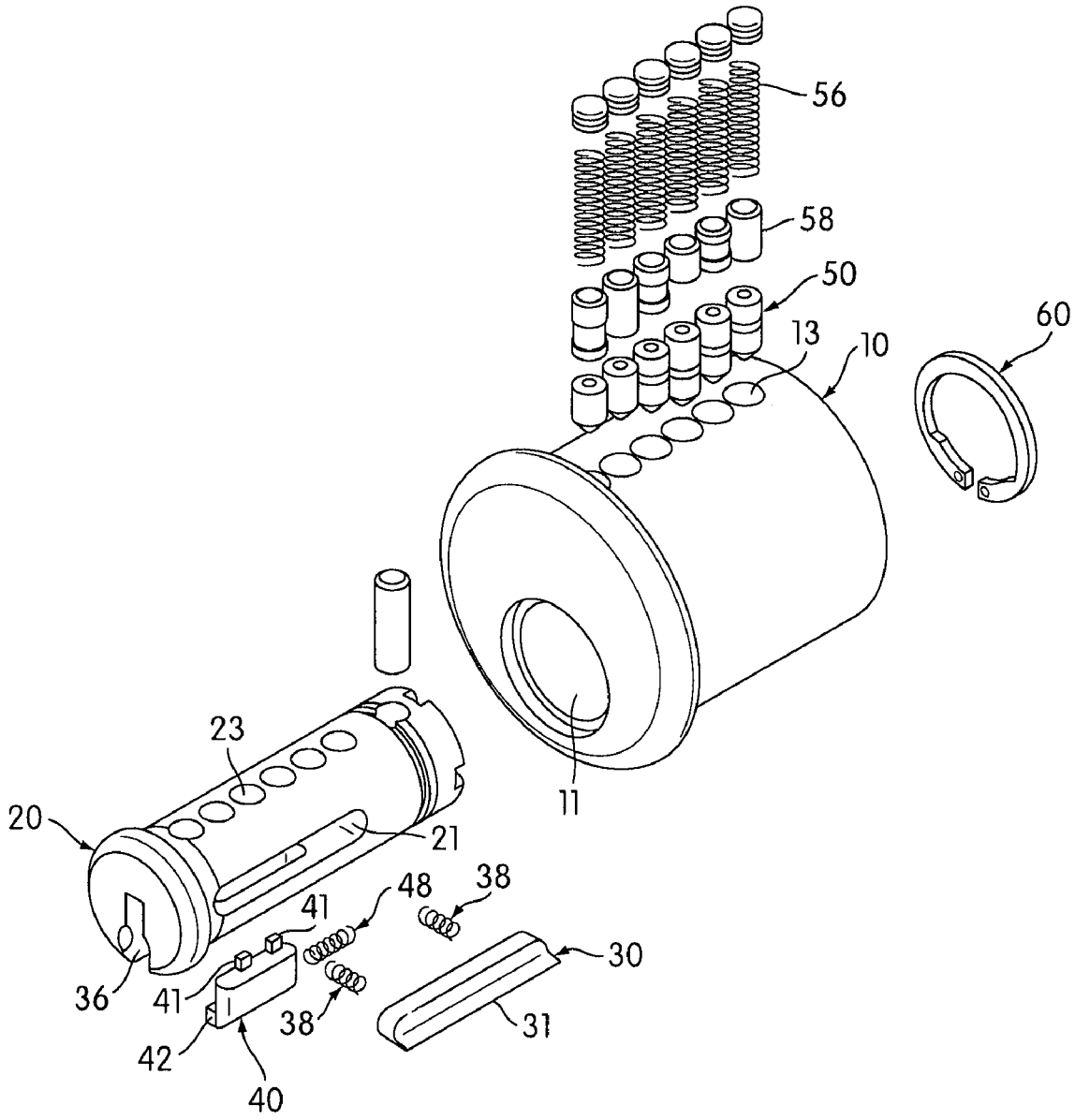
FIG. 2 is a right-hand exploded perspective view of the cylinder shown in FIG. 1.
Figure 3:
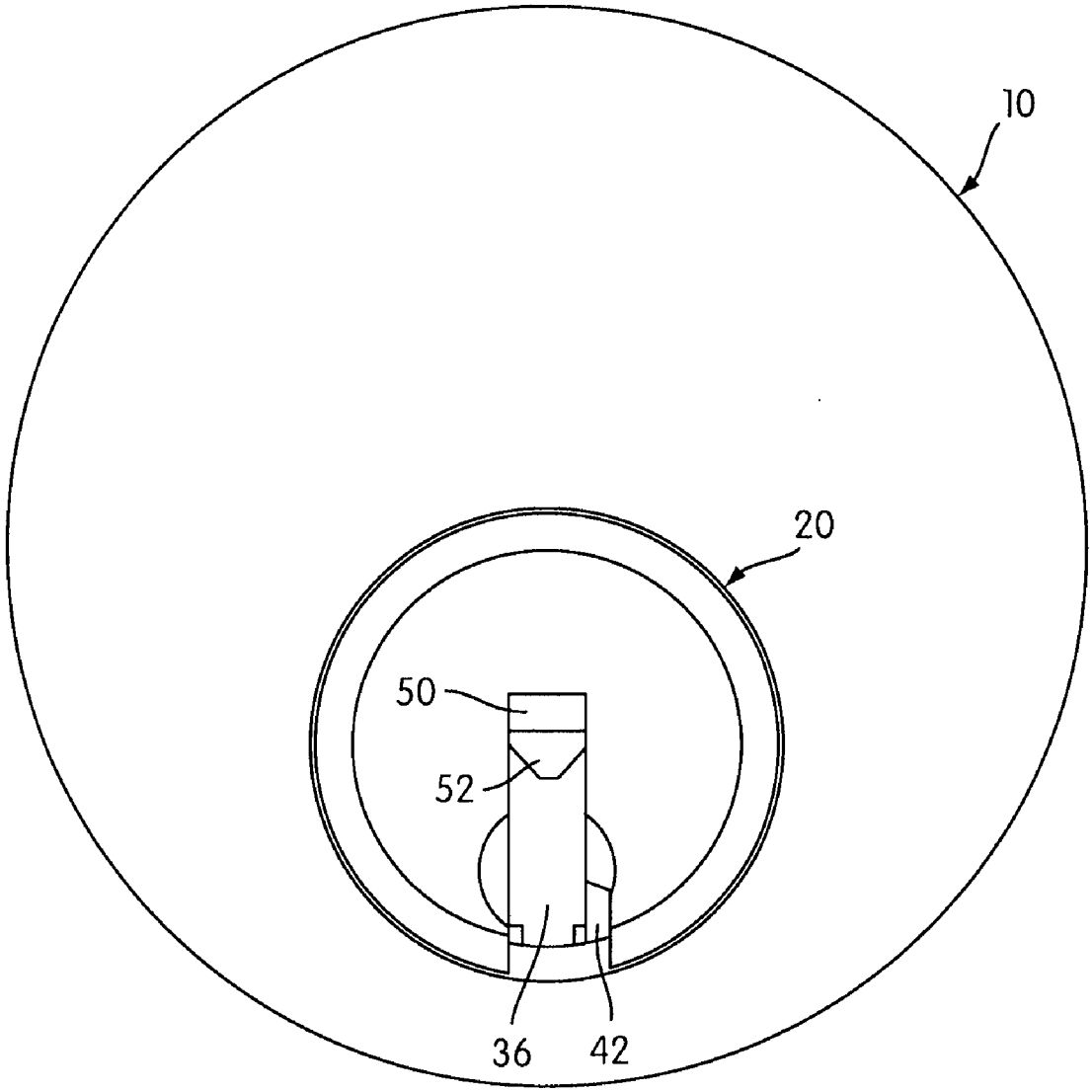
FIG. 3 is a front view of the cylinder shown in FIG. 1.

FIGS. 1, 2 and 3 show the new and novel cylinder of this invention. This new cylinder can be used as a standard security cylinder and can be operated by keys of the type disclosed in U.S. Pat. No. 6,945,082. As described in more detail below, the cylinder of FIGS. 1-3 can be operated without rotating the pin tumblers into proper positions, but includes a sidebar and blocking slider arrangement which controls operation of the cylinder. Without the mechanism to read precisely rotated pins of the prior art, the cylinder of the present invention has a reduced cost to manufacture, while the sidebar/slider mechanism offers additional security over prior art standard security cylinder designs.

Figure 4:
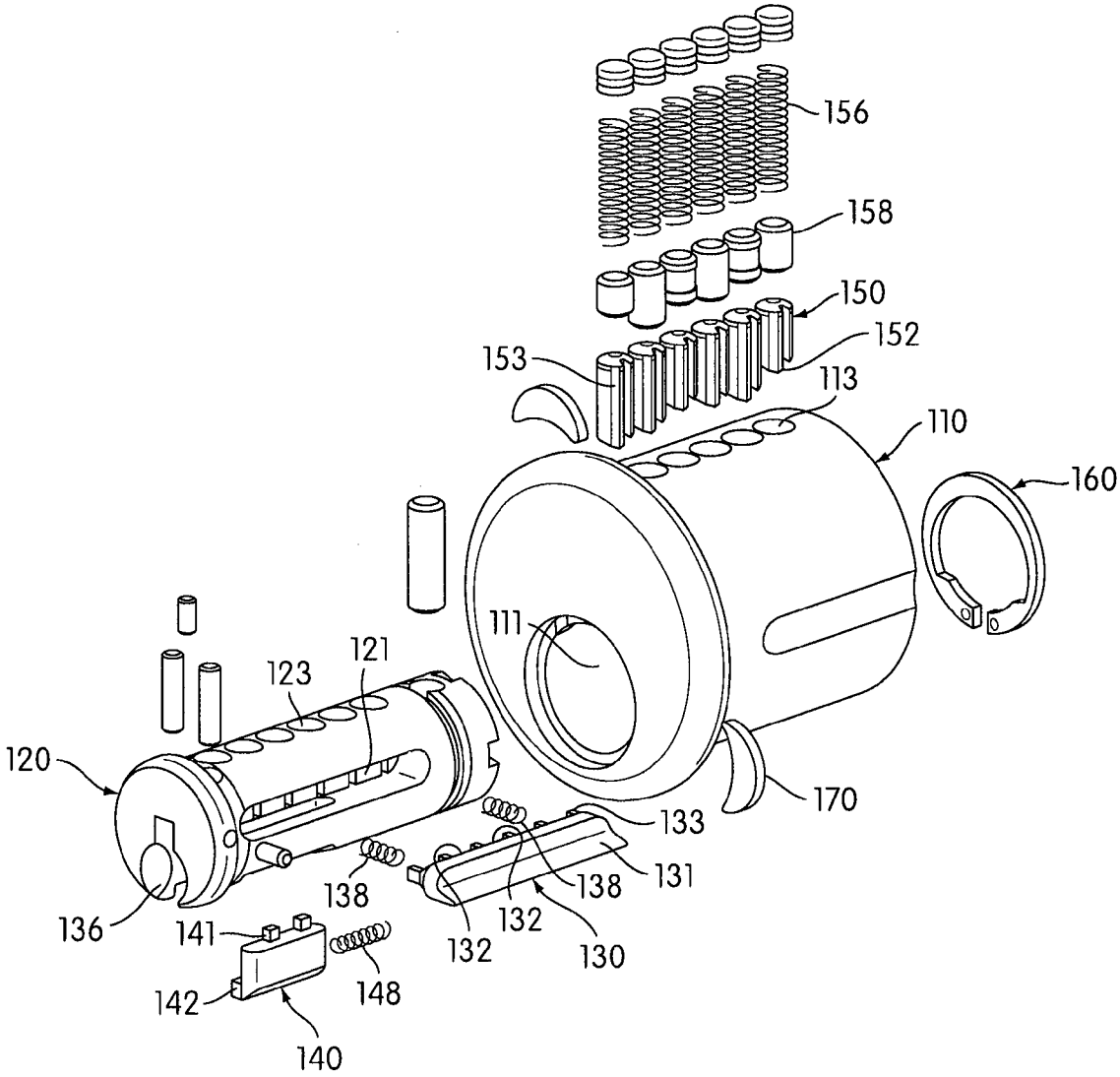
FIG. 4 PRIOR ART
FIG. 4 is a right-hand exploded perspective view of a prior art high security cylinder.
Figure 5:
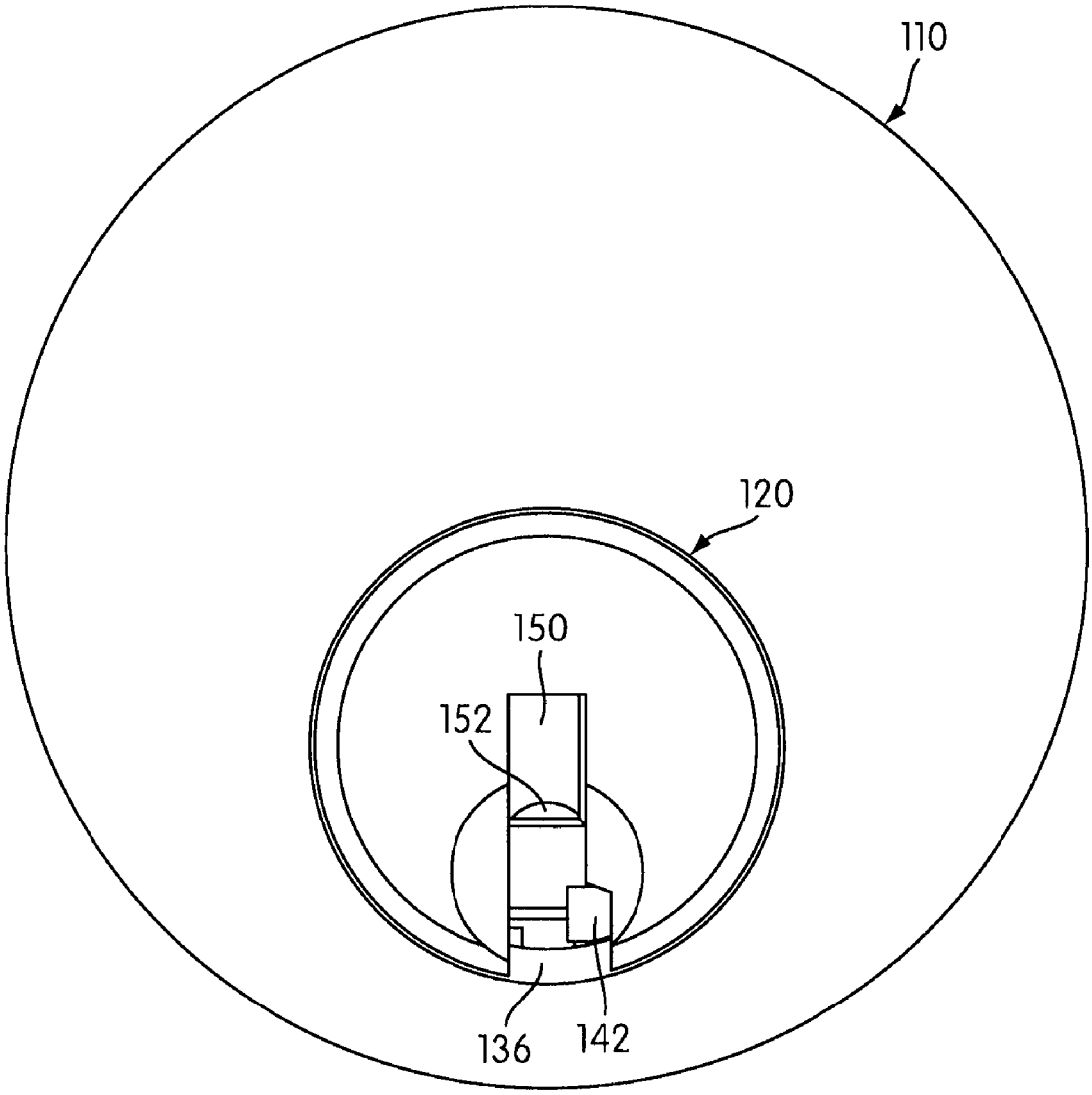
FIG. 5 PRIOR ART
FIG. 5 is a front view of the cylinder shown in FIG. 4.

FIGS. 4 and 5 are prior art high security cylinders of the type manufactured by Medeco Security Locks, Inc. of Salem, Va. and which are disclosed in U.S. Pat. No. 6,477,875. As with the cylinder shown in FIGS. 1, 2, and 3, the cylinder of FIGS. 4 and 5 can also be operated by keys of the kinds disclosed in U.S. Pat. No. 6,945,082. This allows for two types of cylinders, one with standard security and one with high security to be arranged in a hierarchical system with keys that operate both levels.

FIG. 1 is an exploded, perspective view of the standard security cylinder of the present invention showing the left hand side of the components. FIG. 2 shows the same components from the right hand side. They illustrate one configuration of a cylinder body or shell 10. The shell 10 has an axial bore 11 in which a cylindrical plug 20 fits and can rotate. The plug 20 is held in place by a retainer 60. In the plug 20 and the shell 10 are tumbler pin holes 23 and 13, respectively, in which pin sets, or tumbler pin assemblies, of various bottom pins 50, top pins 58, and springs 56 are positioned. Arrangements of spring loaded pins provide master keying capability and are well known in the lock art. The pins 50 have conical tips 52, and can be properly positioned to permit rotation of the plug 20 within the shell 10 merely by being elevated to the correct position by a key having the proper bitting pattern. Rotation of the pins 50 is not necessary, and the biting of the key need not be angularly chiseled or skewed.

A sidebar 30 is positioned in a cavity 21 formed in the side of the plug 20. The sidebar 30 has a beveled projection 31 that extends into an axial sidebar groove 12 formed in the sidewall of the axial bore 11 in the shell 10. The sidebar 30 is urged radially outwardly from the rotational axis of the plug 20, for example, by springs 38, so that the beveled projection 31 is urged into engagement with the sidebar groove 12. The plug 20 cannot be rotated to unlock the lock until the sidebar 30 is moved radially toward the rotational axis of the plug 20, and the beveled projection 31 is disengaged from the sidebar groove 12.

A slider 40 is positioned adjacent the sidebar 30 and has at least one tab 41 that is engaged by a side 34 of the sidebar 30 to prevent the sidebar 30 from moving radially out of engagement from the sidebar groove 12. The slider 40 is biased axially, for example, by a spring 48, toward the front end of the plug 20. A proper key (described below) inserted into a keyway 36 has a projection that engages a contact surface 42 on the slider 40 to move the slider 40 axially so as to align slider opening(s) 32 formed in the side 34 of the sidebar with the tab(s) 41 of the slider 40.

As the plug 20 is turned under control of the key, the beveled projection 31 moves in the sidebar groove 12, and this action forces the sidebar 30 to move radially into the plug 20. The radial movement of the sidebar 30 with respect to the slider 40 and the plug 20 is enabled by the alignment of the slider opening(s) 32 with the tab(s) 41.

As explained in U.S. Pat. Nos. 6,477,875 and 6,945,082, the slider contact areas on the key engage the contact surface 42 on the slider 40 and position the slider to an exact axial location. When the slider 40 is in this operating position, the slider tab 41 is aligned with the slider opening 32, and the sidebar 30 can move far enough to allow rotation of the plug 20. Thus, the slider 40 controls the release of the sidebar 30.

FIG. 3 is a front view of the standard security cylinder, illustrating the plug 20 disposed within the shell 10 and the conical tip 52 of a bottom pin 50 and the contact surface 42 of the slider 40 extending into the keyway 36.

FIG. 4 is an exploded view of a prior art high security cylinder which may be used in a hierarchical lock system in conjunction with the standard security cylinder of FIGS. 1-3. Rotating or twisting tumbler locks with side bar control of the tumblers and keys for operating such locks are well known in the prior art and have been manufactured and sold by Medeco Security Locks, Inc. of Salem, Va. for over twenty years. Examples of such cylinders can be found in the following patents assigned to Medeco Security Locks, Inc.: U.S. Pat. No. 3,499,302 Spain et al (1970) U.S. Pat. No. 3,722,240 Spain et al (1973), U.S. Pat. No. 4,635,455 Oliver (1987), U.S. Pat. No. 5,289,709 Field (1994), U.S. Pat. No. 5,419,168 Field (1995), U.S. Pat. No. 5,570,601 Field (1996), U.S. Pat. No. 5,615,565 Field (1997), and U.S. Pat. No. 6,023,954 Field (2000). With the addition of a slider, controlling the sidebar as shown in U.S. Pat. Nos. 6,477,875 and 6,945,082, the security of these cylinders is further enhanced.

FIGS. 4 and 5 illustrate one configuration of a cylinder body or shell 110. The shell has an axial bore 111 in which the plug 120 fits and can rotate. The plug 120 is held in place by a retainer 160. A sidebar 130 is positioned in a cavity 121 in the side of the plug 120. The sidebar has a beveled projection 131 that extends into a sidebar groove (not shown) formed in the side wall of the axial bore 111 in the shell 110. Sidebar legs 133 project radially inwardly from the sidebar 130. A slider 140 is positioned adjacent the sidebar 130. Additionally the high security level cylinder has drill resistant inserts 170 in the cylinder to provide attack protection.

In the plug 120 and the shell 110 are tumbler pin holes 123 and 113, respectively, in which tumbler pin assemblies of various chisel pointed bottom pins 150, top pins 158, and springs 156 are positioned. Arrangements of spring loaded pins are well known in the lock arts, and they can provide master keying capability. The tips 152 of the rotating pins 150 are chisel pointed, and when a correctly bitted key is inserted into the plug, the springs push the pins into the angled cuts on the keys, as explained in the Medeco patents listed above. This action causes the pins to elevate and rotate to an exact location. In the side of the pins is at least one sidebar leg slot 153 designed to accept a leg 133 of a sidebar 130.

As a plug is turned under control of a key (not shown), the beveled projection 131 moves in the sidebar slot, and this action forces the sidebar 130 into the plug 120 against a biasing force, such as springs 138. Proper rotation of the pins 150 aligns the sidebar leg slot 153 on each pin 150 with one of the sidebar legs 133 and allows the sidebar leg 133 to fit into the pin. In one side of the sidebar there is at least one slider opening 132, and on the slider 140 there is at least one slider tab 141 that extends upwards behind the sidebar 130. The slider is spring loaded and is positioned axially in the plug by the key as it is inserted into the cylinder. As explained in U.S. Pat. Nos. 6,477,875 and 6,945,082, the slider contact areas on the key engage the contact surface 142 on the slider 140 and position the slider 140 to an exact axial location with respect to the sidebar 130. When the slider is in this operating position, the slider tab 141 is aligned with the slider opening 132, and the sidebar 130 can move far enough to allow rotation of the plug 120. Both the alignment of the pins and the slider control the release of the sidebar so as to permit rotation of the plug 120.

FIG. 5 is a front view of the prior art high security level cylinder, illustrating the plug 120 disposed within the shell 110 and the chiseled tip 152 of a bottom pin 150 and the contact surface 142 of the slider 40 extending into the keyway 136.

Figure 6A:
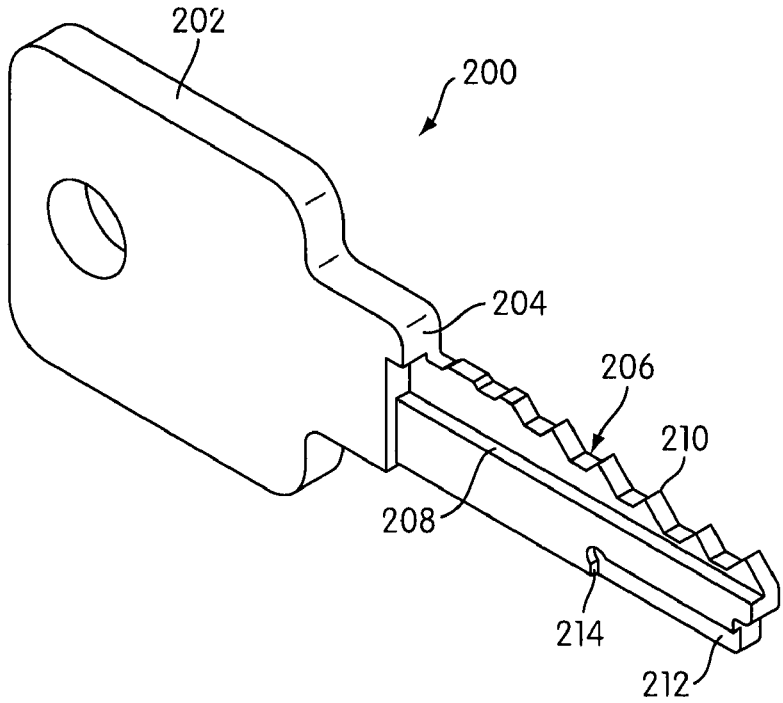
FIG. 6A is a perspective view of a key adapted to elevate tumbler pins and to engage and move a slider.
Figure 6B:
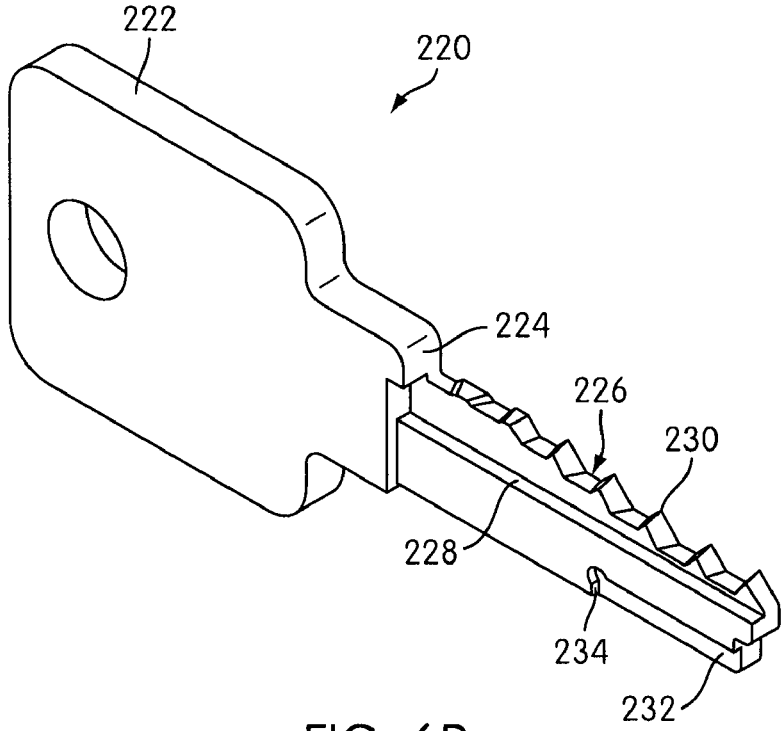
FIG. 6B is a perspective view of a key adapted to elevate and rotate tumbler pins and to engage and move a slider.

Keys for use in the hierarchical lock system of the present invention are shown in FIGS. 6A and 6B. FIG. 6A shows a key 200 with a bow 202 and a key stop 204 with a blade 206 extending from the key stop 204. Blade 206 includes bitting 210 and a profile, for example, defined by a longitudinal rib 208, which conforms to the keyway of a lock. Key 200 includes standard straight bitting 210, which will elevate the tumblers but will not rotate the tumblers. Key 200 further includes a longitudinally extending cutout 212 having a contact surface 214 defined at an end thereof. The key 200 shown in FIG. 6A will operate the locks of the type shown in the FIGS. 1, 2, and 3. That is, the bitting 210 will elevate the tumbler assemblies, and the contact surface 214 will contact the projection 42 of the slider 40 and move the slider to a non-interfering position with respect to the sidebar 30. Key 200 will not operate the locks shown in FIGS. 4 and 5, as those locks require that the tumbler pins be elevated and rotated, which key 200 is incapable of doing. Key 220 shown in FIG. 6B also includes a bow 222 and a key stop 224 from which the key blade 226 extends. The key blade includes a profile, for example, defined by longitudinal rib 228, and bitting 230. A longitudinal cutout 232 extends along a portion of the blade 226 and ends in a contact surface 234. The bitting 230 of the blade 220 is chiseled, so that, when the biting engages a complementarily chiseled tumbler pin, the biting will elevate and rotate the pin. Accordingly, the key 220 shown in FIG. 6B will operate the locks shown in FIGS. 4 and 5. In addition, key 220 will also operate the locks shown in FIGS. 1, 2, and 3. Thus, in a hierarchical lock system, key 220 is a master key, while the key 200 is a subordinate key.

Thus, the standard security cylinder shown in FIGS. 1, 2, and 3 can be operated by a key having the correct bitting to properly elevate the pin tumblers 50 and the correct slider-engaging rib to axially position the slider 40 with the slider tab(s) 41 aligned with the slider opening(s) 32 formed on the sidebar 30. Both high security keys, having chiseled, angular or skewed bittings, and standard security keys, having non-angled bittings, can operate the standard security cylinder. On the other hand, the high security cylinder shown in FIGS. 4 and 5 can only be operated by a key having the correct bitting to properly elevate and rotate the pin tumblers 150 and the correct slider-engaging rib to axially position the slider 140 with the slider tab(s) 141 aligned with the slider opening(s) 132. Thus, only the high security key, with chiseled, angular bitting, will operate the high security lock of FIGS. 4 and 5.

Thus, the standard security cylinder of the present invention provides a security enhancement over prior art standard security cylinders which require only the proper elevational positioning of the pin tumblers to permit operation of the cylinder. The standard security cylinder of the present invention also requires the proper positioning of the slider with respect to the sidebar. This security enhancement of the standard security cylinder of the present invention is accomplished without the expense and complexity of prior art high security cylinders which require elevational positioning and rotation of the pin tumblers in addition to the proper positioning of the slider.

Accordingly, the standard security cylinder of FIGS. 1-3 and the high security cylinder of FIGS. 4 and 5 could form lower and upper levels, respectively, of a two-level hierarchical lock system. Alternatively, the standard security cylinder of FIGS. 1-3 and the high security cylinder of FIGS. 4 and 5 could form mid and upper levels, respectively, of a three-level hierarchical lock system, with a prior art standard security cylinder operable upon the proper elevation of the pin tumblers forming the lower level of the system.

While the present invention has been described and shown in considerable detail with disclosure to certain preferred embodiments, those skilled in the art will readily appreciate other embodiments of the present invention. Accordingly, the present invention is deemed to include all modifications and variations encompassed within the spirit and scope of the following appended claims.

The invention claimed is:

1. A hierarchical lock system, comprising:

A at least one lock having a first level of security, said first security level lock comprising:

(1) a shell having a bore formed therein;

(2) a cylindrical plug having an axis and an axially-extending keyway adapted to receive a conforming key, wherein the bore formed in said shell is adapted to receive the cylindrical plug;

(3) a plurality of tumbler pin assemblies disposed within tumbler pin holes formed in said shell and said cylindrical plug and adapted to control rotation of the cylindrical plug with respect to said shell, each tumbler pin assembly being reciprocally moveable within an associated tumbler pin hole, wherein engagement of the tumbler pin assemblies by the bitting of a properly configured key inserted into the keyway will elevate the tumbler pin assemblies within their associated tumbler pin holes so as to permit the cylindrical plug to rotate with respect to said shell;

(4) an axially-elongated sidebar that is generally parallel to the longitudinal axis of the cylindrical plug and having an outer end that is engageable with a sidebar groove formed in the wall of the bore formed in said shell, wherein engagement of the sidebar with the sidebar groove blocks rotation of the cylindrical plug with respect to the shell; and (5) a slider disposed with respect to the cylindrical plug and adapted to move axially relative to the cylindrical plug, when engaged by a properly configured key inserted into the keyway, from a first position to a second position, wherein radial movement of the sidebar is controlled only by the slider, such that with the slider in the first position, the slider interferes with the sidebar to block the sidebar from moving radially inwardly toward the axis of the cylindrical plug, and with the slider in the second position, the slider does not interfere with the sidebar, thereby permitting the sidebar to move radially toward the axis of the cylindrical plug so that the sidebar disengages from the sidebar groove and permits the cylindrical plug to rotate within the bore formed in the shell;

wherein the first security level lock is unlocked when the tumbler pin assemblies are elevated so as to permit the cylindrical plug to rotate with respect to the shell and the slider is moved to its second position so as to permit the sidebar to move radially inwardly and disengage from the sidebar groove;

B at least one lock having a second level of security, said second security level lock comprising:

(1) a shell having a bore formed therein;

(2) a cylindrical plug having an axis and an axially-extending keyway, wherein the bore formed in said shell is adapted to receive the cylindrical plug;

(3) a plurality of tumbler pin assemblies disposed within tumbler pin holes formed in said shell and said cylindrical plug and adapted to control rotation of the cylindrical plug within the bore formed in said shell, each tumbler pin assembly being reciprocally moveable within an associated tumbler pin hole, wherein engagement of the tumbler pin assemblies by the bitting of a properly configured key inserted into the keyway will elevate the tumbler pin assemblies within their associated tumbler pin holes so as to permit the cylindrical plug to rotate with respect to said shell, at least a portion of at least one tumbler pin assembly being rotatable within its tumbler pin hole and including a beveled point adapted to cause rotation when engaged by a properly beveled bitting of a key inserted into the keyway;

(4) an axially-elongated sidebar that is generally parallel to the longitudinal axis of the cylindrical plug and having an outer end that is engageable with a sidebar groove formed in the wall of the bore formed in said shell, wherein engagement of the sidebar with the sidebar groove blocks rotation of the cylindrical plug within the bore formed in the shell, wherein at least one of the tumbler pin assemblies blocks movement of the sidebar unless the tumbler pin assembly is rotated to a correct position to thereby enable the sidebar to move radially toward the axis of the cylindrical plug so that the sidebar disengages from the sidebar groove and permits the cylindrical plug to rotate within the bore formed in the shell; and (5) a slider disposed with respect to the cylindrical plug and adapted to move axially relative to the cylindrical plug, when engaged by a properly configured key, from a first position to a second position, whereby in the first position, the slider interferes with the sidebar to block the sidebar from moving radially inwardly toward the axis of the cylindrical plug, and when the slider is in the second position, the slider does not interfere with the sidebar, thereby permitting the sidebar to move radially toward the axis of the cylindrical plug so that the sidebar disengages from the sidebar groove and permits the cylindrical plug to rotate within the bore formed in the shell;

wherein the second security lock is unlocked when the tumbler pin assemblies are elevated so as to permit the cylindrical plug to rotate with respect to the shell, the tumbler pin assemblies are rotated to an orientation such that inward radial movement of the sidebar is not blocked by any tumbler assemblies and the slider is moved to its second position so as to permit the sidebar to move radially inwardly and disengage from the sidebar groove;

wherein the elevations of the tumbler pin assemblies which permit the cylindrical plug to rotate with respect to the shell are the same for the first security level lock and the second security level lock, and wherein the first security level lock requires no rotation of any of the tumbler pin assemblies to permit the cylindrical plug to rotate with respect to the shell;

C at least one dual level key constructed and arranged to:

(1) open the first security level lock by (a) elevating the tumbler pin assemblies of the first security level lock to elevations permitting the cylindrical plug of the first security level lock to rotate with respect to the shell, and (b) moving the slider of the first security level lock to its second position so as to permit the sidebar of the first security level lock to move radially inwardly and disengage from the sidebar groove; and (2) open the second security level lock by (a) elevating the tumbler pin assemblies of the second security level lock to elevations permitting the cylindrical plug of the second security level lock to rotate with respect to the shell, (b) rotating the tumbler pin assemblies of the second security level lock to an orientation such that inward radial movement of the sidebar of the second security level lock is not blocked by any tumbler pin assemblies, and (c) moving the slider of the second security level lock to its second position so as to permit the sidebar of the second security level lock to move radially inwardly and disengage from the sidebar groove; and D at least one single level key constructed and arranged to:

(1) open the first security level lock by (a) elevating the tumbler pin assemblies of the first security level lock to elevations permitting the cylindrical plug of the first security level lock to rotate with respect to the shell, and (b) moving the slider of the first security level lock to its second position so as to permit the sidebar of the first security level lock to move radially inwardly and disengage from the sidebar groove; wherein (2) the single level key is not configured to rotate the any tumbler pin assemblies of the second security level lock and therefore cannot open the second security level lock.

2. The system of claim 1, wherein the dual level key comprises:

a key blade with a profile complementary to a configuration of the profile of the keyways of the first and second security level locks;

bitting formed on the key blade and adapted to elevate the tumbler pin assemblies of the first security level lock to elevations which allow the cylindrical plug of the first security level lock to rotate and to elevate and rotate the tumbler pin assemblies of the second security level lock to elevations and orientations which allow the cylindrical plug of the second security level lock to rotate and unblock the sidebar of the second security level lock;

at least one rib on the key; and a contact surface on the rib for cooperating with the slider of the first and second security level locks and moving the slider parallel to the axis of the cylindrical plug to unblock the sidebar of each of the first and second security level locks.

3. The system of claim 2, wherein the single level key comprises:

a key blade with a profile complementary to the configuration of the profile of the keyways of the first and second security level locks;

bitting formed on the key blade and adapted to elevate the tumbler pin assemblies of the first security level lock to elevations which allow the cylindrical plug of the first security level lock to rotate;

at least one rib on the key; and a contact surface on the rib for cooperating with the slider of the first security level lock and moving the slider parallel to the axis of the cylindrical plug to unblock the sidebar of the first security level lock.

4. The system of claim 1, wherein the sliders of the first and second security level locks are biased in a direction parallel to the axis of the cylindrical plug.

5. The system of claim 4, wherein the bias is provided by a spring in the cylindrical plug to force the slider in a direction toward an entrance of the keyway.

6. The system of claim 1, wherein the sliders of the first and second security level locks have a projection which extends into the keyway for contacting the key.

7. The system of claim 6, wherein the projection is shaped to cooperate with a portion of a key when inserted into the keyway.

8. The system of claim 1, wherein the sliders of the first and second security level locks have spaced tabs, which contact a portion of the sidebars to prevent operation of the sidebars unless the sliders are moved to the second position at which the tabs of the sliders are aligned with openings formed in the sidebars.

9. The system of claim 1, wherein the sidebar of the second security level lock includes one or more sidebar legs extending toward the axis of the cylindrical plug and at least one tumbler pin assembly of the second security level lock includes a sidebar leg slot adapted to receive the sidebar leg when rotated to a correct position to thereby unblock the sidebar and permit the sidebar to move radially toward the axis of the cylindrical plug so that the sidebar disengages from the sidebar groove and permits the cylindrical plug to rotate within the bore formed in the shell.

10. The system of claim 1, wherein the sidebars of the first and second security level locks are biased in a direction radially outwardly from the axis of the cylindrical plug.

11. The system of claim 10, wherein the bias is provided by one or more springs in the cylindrical plug to force the sidebar in a direction toward the wall of the bore formed in the shell.

12. A key and a cylinder lock system comprising a first cylinder lock comprising:

a rotatable cylinder with an axis and a keyway, an axially-elongated sidebar that is generally parallel to the longitudinal axis of the cylinder and is moveable between a first position blocking rotation of the cylinder and a second position allowing rotation of the cylinder, rotatable, reciprocating tumblers adapted to control rotation of the cylinder, wherein at least one tumbler is adapted to prevent movement of the sidebar from the first position to the second position unless the tumbler is rotated to a non-interfering orientation with respect to the sidebar, and a slider for controlling movement of the sidebar from the first position to the second position, a projection on the slider extending into the keyway;

a second cylinder lock comprising:

a rotatable cylinder with an axis and a keyway, an axially-elongated sidebar that is generally parallel to the longitudinal axis of the cylinder and is moveable between a first position blocking rotation of the cylinder and a second position allowing rotation of the cylinder, reciprocating tumblers adapted to control rotation of the cylinder without requiring that any of the tumblers rotate, and a slider for controlling movement of the sidebar from the first position to the second position, a projection on the slider extending into the keyway;

a first key comprising:

a key blade with a profile complementary to the configuration of the profile of the keyways of the first and second cylinder locks;

bitting formed on the key blade and adapted to (1) elevate and rotate the tumblers of the first cylinder lock to elevations and orientations which (a) allow the cylinder of the first cylinder lock to rotate and (b) unblock movement of the sidebar of the first cylinder lock from the first position to the second position and (2) elevate the tumblers of the second cylinder lock to elevations which allow the cylinder of the second cylinder lock to rotate;

at least one rib on the key; and a contact surface on the rib for cooperating with the projections of the first and second cylinder locks and moving the slider parallel to the axis of the cylinder to unblock movement of the sidebar of the first and second cylinder locks from the first position to the second position; and a second key comprising:

a key blade with a profile complementary to the configuration of the profile of the keyways of the first and second cylinder locks;

bitting formed on the key blade and adapted to elevate the tumblers of the second cylinder lock to elevations which allow the cylinder of the second cylinder lock to rotate;

at least one rib on the key; and a contact surface on the rib for cooperating with the projection of the second cylinder lock and moving the slider parallel to the axis of the cylinder to unblock movement of the sidebar of the second cylinder lock from the first position to the second position, wherein the second key is not adapted to rotate the tumblers of the first cylinder lock and is therefore unable to open the first cylinder lock.

13. A set of keys for opening one or more locks in a hierarchical lock system including a first cylinder lock having a rotatable cylinder with an axis and a keyway, a movable sidebar for controlling rotation of the cylinder, rotatable, reciprocating tumblers for controlling rotation of the cylinder and movement of the sidebar, and a slider adapted to be engaged by a key inserted into the keyway for controlling movement of the sidebar and a second cylinder lock having a rotatable cylinder with an axis and a keyway, a movable sidebar for controlling rotation of the cylinder, reciprocating tumblers for controlling rotation of the cylinder, and a slider adapted to be engaged by a key inserted into the keyway for controlling movement of the sidebar, the set of keys comprising:

a first key comprising a key blade adapted to fit into the keyways of the first and second cylinder locks and including a bitting surface configured to (1) elevate the tumblers of the first cylinder lock to elevations which allow the cylinder of the first cylinder lock to rotate, (2) rotate the tumblers of the first cylinder lock to orientations which unblock the sidebar of the first cylinder lock, and (3) elevate the tumblers of the second cylinder lock to elevations which allow the cylinder of the second cylinder lock to rotate, the blade being further configured to engage the sliders of the first and second cylinder locks and move the slider parallel to the axis of the cylinder to unblock the sidebar of the first and second cylinder locks; and a second key comprising a key blade adapted to fit into the keyways of the first and second cylinder locks and including a bitting surface configured to elevate without rotating the tumblers of the second cylinder lock to elevations which allow the cylinder of the second cylinder lock to rotate, the blade being further configured to engage the slider of the second cylinder lock and move the slider parallel to the axis of the cylinder to unblock the sidebar of the second cylinder lock, wherein the bitting surface of the second key is not configured to rotate the tumblers of the first cylinder lock and is therefore unable to open the first cylinder lock.

14. The set of keys of claim 13, wherein the sliders of the first and second cylinder locks each include a projection on the slider extending into the respective keyway, and wherein the first and second keys each further include at least one rib on the key blade and a contact surface on the rib for engaging the projection of each of the first and second sliders and moving each slider parallel to the axis of the cylinder to unblock the sidebar.

15. A hierarchical lock system, comprising:

A at least one lock having a first level of security, said first security level lock comprising:

(1) a shell having a bore formed therein;

(2) a cylindrical plug having an axis and an axially-extending keyway adapted to receive a conforming key, wherein the bore formed in said shell is adapted to receive the cylindrical plug;

(3) a plurality of tumbler pin assemblies disposed within tumbler pin holes formed in said shell and said cylindrical plug and adapted to control rotation of the cylindrical plug with respect to said shell, each tumbler pin assembly being reciprocally moveable within an associated tumbler pin hole, wherein engagement of the tumbler pin assemblies by the bitting of a properly configured key inserted into the keyway will elevate the tumbler pin assemblies within their associated tumbler pin holes so as to permit the cylindrical plug to rotate with respect to said shell;

(4) an axially-elongated sidebar that is generally parallel to the longitudinal axis of the cylindrical plug and having an outer end that is engageable with a sidebar groove formed in the wall of the bore formed in said shell, wherein engagement of the sidebar with the sidebar groove blocks rotation of the cylindrical plug with respect to the shell; and (5) a slider disposed with respect to the cylindrical plug and adapted to move axially relative to the cylindrical plug, when engaged by a properly configured key inserted into the keyway, from a first position to a second position, wherein radial movement of the sidebar is controlled only by the slider, such that with the slider in the first position, the slider interferes with the sidebar to block the sidebar from moving radially inwardly toward the axis of the cylindrical plug, and with the slider in the second position, the slider does not interfere with the sidebar, thereby permitting the sidebar to move radially toward the axis of the cylindrical plug so that the sidebar disengages from the sidebar groove and permits the cylindrical plug to rotate within the bore formed in the shell;

wherein the first security level lock is unlocked when the tumbler pin assemblies are elevated so as to permit the cylindrical plug to rotate with respect to the shell and the slider is moved to its second position so as to permit the sidebar to move radially inwardly and disengage from the sidebar groove; and B at least one lock having a second level of security, said second security level lock comprising:

(1) a shell having a bore formed therein;

(2) a cylindrical plug having an axis and an axially-extending keyway, wherein the bore formed in said shell is adapted to receive the cylindrical plug;

(3) a plurality of tumbler pin assemblies disposed within tumbler pin holes formed in said shell and said cylindrical plug and adapted to control rotation of the cylindrical plug within the bore formed in said shell, each tumbler pin assembly being reciprocally moveable within an associated tumbler pin hole, wherein engagement of the tumbler pin assemblies by the bitting of a properly configured key inserted into the keyway will elevate the tumbler pin assemblies within their associated tumbler pin holes so as to permit the cylindrical plug to rotate with respect to said shell, at least a portion of at least one tumbler pin assembly being rotatable within its tumbler pin hole and including a beveled point adapted to cause rotation when engaged by a properly beveled bitting of a key inserted into the keyway;

(4) an axially-elongated sidebar that is generally parallel to the longitudinal axis of the cylindrical plug and having an outer end that is engageable with a sidebar groove formed in the wall of the bore formed in said shell, wherein engagement of the sidebar with the sidebar groove blocks rotation of the cylindrical plug within the bore formed in the shell, wherein at least one of the tumbler pin assemblies blocks movement of the sidebar unless the tumbler pin assembly is rotated to a correct position to thereby enable the sidebar to move radially toward the axis of the cylindrical plug so that the sidebar disengages from the sidebar groove and permits the cylindrical plug to rotate within the bore formed in the shell; and (5) a slider disposed with respect to the cylindrical plug and adapted to move axially relative to the cylindrical plug, when engaged by a properly configured key, from a first position to a second position, whereby in the first position, the slider interferes with the sidebar to block the sidebar from moving radially inwardly toward the axis of the cylindrical plug, and when the slider is in the second position, the slider does not interfere with the sidebar, thereby permitting the sidebar to move radially toward the axis of the cylindrical plug so that the sidebar disengages from the sidebar groove and permits the cylindrical plug to rotate within the bore formed in the shell;

wherein the second security lock is unlocked when the tumbler pin assemblies are elevated so as to permit the cylindrical plug to rotate with respect to the shell, the tumbler pin assemblies are rotated to an orientation such that inward radial movement of the sidebar is not blocked by any tumbler assemblies and the slider is moved to its second position so as to permit the sidebar to move radially inwardly and disengage from the sidebar groove;

wherein the elevations of the tumbler pin assemblies which permit the cylindrical plug to rotate with respect to the shell are the same for the first security level lock and the second security level lock.

* * * * *